US006767152B1

(12) United States Patent
Wehmeyer et al.

(10) Patent No.: US 6,767,152 B1
(45) Date of Patent: Jul. 27, 2004

(54) BINDER WITH END POCKET

(75) Inventors: Stephen D. Wehmeyer, Cincinnati, OH (US); Michael K. Brann, Dayton, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 10/458,994

(22) Filed: Jun. 11, 2003

(51) Int. Cl.[7] ..... B42F 13/00

(52) U.S. Cl. ..... 402/73; 150/113; 150/131; 229/67.3; 281/15.1; 281/29; 281/31; 402/4; 402/80 R; D19/26

(58) Field of Search ..... 402/4, 70, 73, 402/80 R, 80 P, 500, 502; D19/26, 27, 32; 229/67.1, 67.3; 281/15.1, 29, 31, 36–38, 51; 150/113, 117, 118, 131

(56) References Cited

U.S. PATENT DOCUMENTS

| | | | | | |
|---|---|---|---|---|---|
| 1,143,171 | A | | 6/1915 | Bushwick | |
| 1,492,677 | A | | 5/1924 | Dunbar et al. | |
| 1,848,980 | A | | 3/1932 | Walker | |
| 1,855,358 | A | | 4/1932 | Maksik | |
| 2,496,128 | A | | 1/1950 | Lifton | |
| 4,961,596 | A | | 10/1990 | Moor | |
| 4,964,508 | A | | 10/1990 | Balsley | |
| 4,986,572 | A | | 1/1991 | Kuykendall | |
| 5,002,401 | A | | 3/1991 | Blackman | |
| 5,294,208 | A | | 3/1994 | Tremmel, Jr. et al. | |
| 5,330,281 | A | * | 7/1994 | Kalan | 402/73 |
| 5,350,249 | A | | 9/1994 | Peters | |
| D352,604 | S | * | 11/1994 | Johnson | D3/303 |
| 5,911,441 | A | * | 6/1999 | Yamamoto et al. | 281/15.1 |
| D415,196 | S | | 10/1999 | Moor | |
| 6,017,062 | A | * | 1/2000 | White | 281/29 |
| D423,574 | S | | 4/2000 | Moor | |
| D424,105 | S | * | 5/2000 | Platte, III | D19/27 |
| D424,615 | S | * | 5/2000 | Wyant | D19/32 |
| 6,059,478 | A | * | 5/2000 | Moor | 402/73 |
| 6,079,528 | A | * | 6/2000 | Moor | 190/126 |
| 6,213,670 | B1 | | 4/2001 | Wien | |
| 6,241,414 | B1 | | 6/2001 | Wien | |
| 6,247,729 | B1 | * | 6/2001 | Kaufman | 281/22 |
| 6,250,834 | B1 | | 6/2001 | Wien | |
| 6,276,722 | B1 | * | 8/2001 | Moor | 281/29 |
| 6,431,779 | B1 | * | 8/2002 | Moor et al. | 402/73 |
| 6,488,433 | B2 | * | 12/2002 | Wien et al. | 402/73 |
| 6,558,062 | B1 | * | 5/2003 | Wyant et al. | 402/73 |

* cited by examiner

*Primary Examiner*—Monica S. Carter
(74) *Attorney, Agent, or Firm*—Thompson Hine LLP

(57) ABSTRACT

A binder including a front cover, a rear cover directly or indirectly coupled to the front cover, and a gusset extending generally between the front and rear covers. The pocket further includes a pocket located on an outer surface of the binder, the pocket at least partially overlapping with at least part of the gusset.

41 Claims, 4 Drawing Sheets

BINDER WITH END POCKET

BACKGROUND

Binders, folders, portfolios, notebooks and the like are often used by businesses, students, etc. in order to store loose items and provide a convenient carrying device. However, many existing binders, folders, notebooks or portfolios may have limited storage space and may in particular lack storage space on an outer surface of the binder.

SUMMARY

The present invention is a binder with a pocket located on an outer surface thereof. In particular, the pocket may be located on, or partially overlap, or at least partially extend along the gusset of the binder. In one embodiment, the invention is a binder including a front cover, a rear cover directly or indirectly coupled to the front cover, and a gusset extending generally between the front and rear covers. The pocket further includes a pocket located on an outer surface of the binder, the pocket at least partially overlapping with at least part of the gusset.

Other objects and advantages of the present invention will be apparent from the following description and the accompanying drawings.

DETAILED DESCRIPTION

Figure 1:
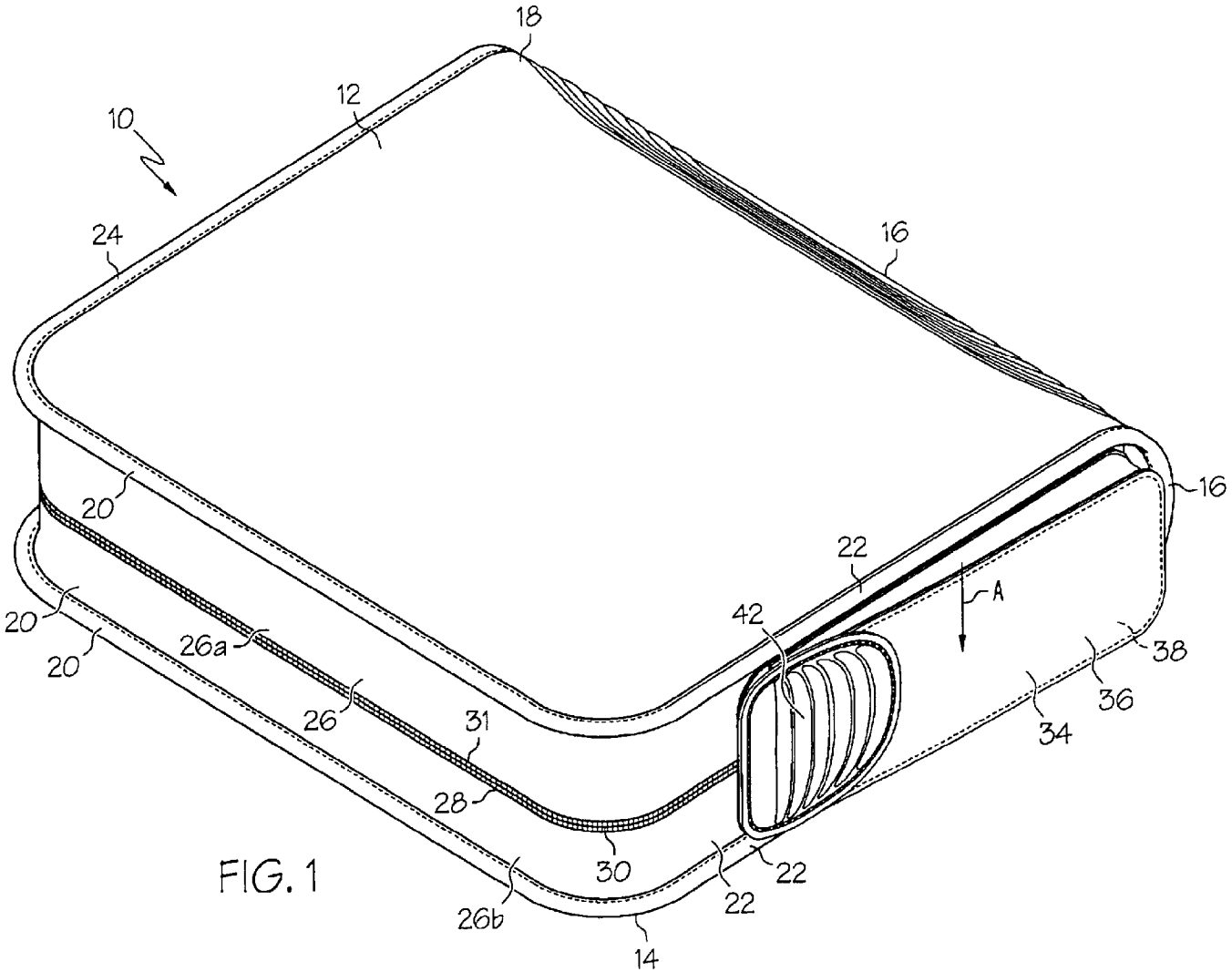
FIG. 1 is a front perspective view of one embodiment of the binder of the present invention, shown in its closed position with the pocket in its compact position.

As shown in FIG. 1, the binder of the present invention, generally designated 10, may include a front cover 12 and a rear cover 14, each of which may be pivotally coupled to a spine 16. Each of the front cover 12, rear cover 14 and spine 16 may be generally planar and generally rectangular, and generally rigid (i.e., sufficiently rigid to support a stack of school materials, such as books and the like, without significant bending or deformation). Each of the front 12 and rear 14 covers may include a rear edge 18 pivotally coupled to the spine 16. When the binder 10 is in its closed position, the binder 10 and each cover 12, 14 may include a first side 20 located opposite the spine 16 or rear edges 18, and the second 22 and third 24 sides extending generally perpendicular to the rear edge 18 and/or first side 20 and between the rear edge 18 and first side 20.

The binder may include a gusset 26 extending around at least or partially around the first 20, second 22 and third 24 sides, and in the illustrated embodiment the gusset 26 does not extend along the rear edges 18. The gusset 26 may be made of a generally flexible, pliable material, such as woven fabric. The gusset 26 may include a cut or slit 28 formed therein to divide the gusset 26 into a first gusset portion 26*a* coupled to the front cover 12 and a second gusset portion 26*b* coupled to the rear cover 14. Each of the first 26*a* and second 26*b* portions may be coupled together by an attachment mechanism, such as in the illustrated embodiment, a zipper 30 including a zipper track 31 and a zipper pull 33. However, the first 26*a* and second 26*b* portions of the gusset 26, as well as the front 12 and rear 14 covers, may be coupled together by a wide variety of other attachment mechanisms including snaps, clasps, hooks, hook and loop fastening systems (such as VELCRO®), interengaging strips and the like.

Figure 3:
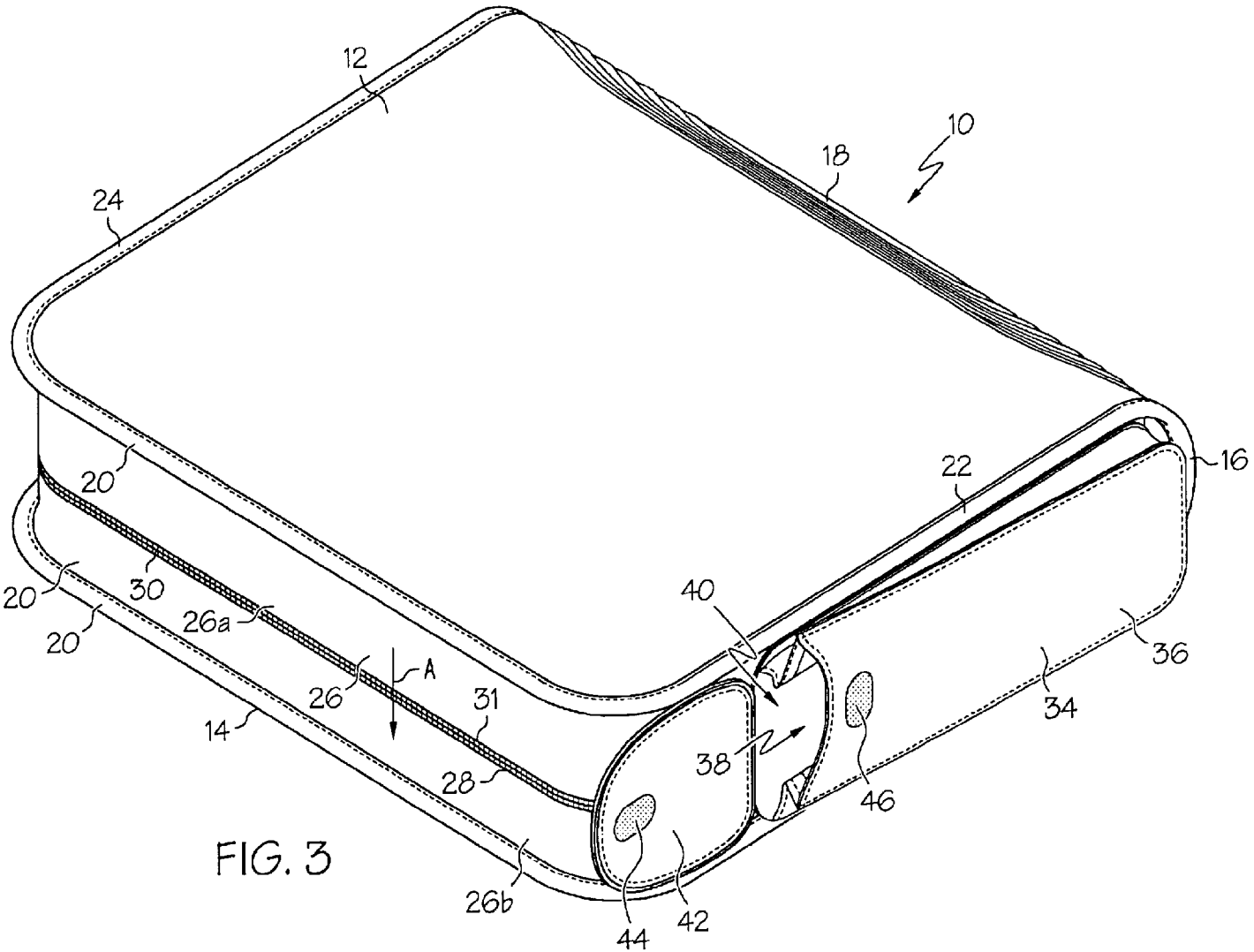
FIG. 3 is a front perspective view of the binder of FIG. 1, with the pocket in its compact position and open configuration.

The binder 10 may include a pocket 34 located on an outer surface thereof. In particular, the pocket 34 may include an outer body 36 having a cavity 38 therein. The pocket may include a mouth or access opening 40 (see FIG. 3) to provide access to the inner cavity 38, and may include a closure flap 42 that can selectively cover the access opening 40. For example, the closure flap 42 may include a patch of hook and loop fastening material 44 such as VELCRO® located thereon which can cooperate with a corresponding patch of hook and loop fastening material 46 located on the front surface of the pocket 34 to maintain the closure flap 42 in the closed position.

Figure 2:
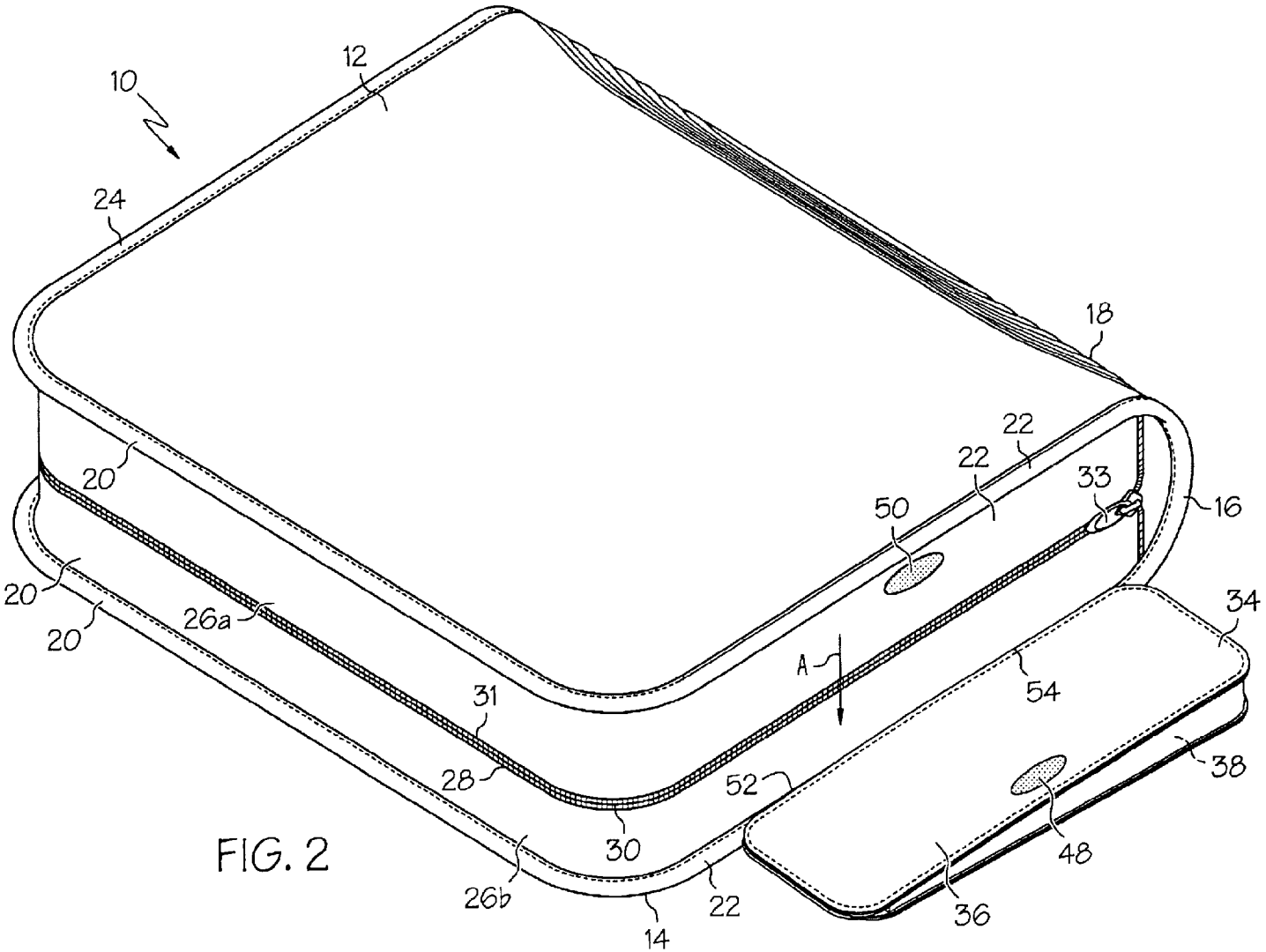
FIG. 2 is a front perspective view of the binder of FIG. 1, with the pocket in its expanded position.

The pocket 34, and correspondingly, the inner cavity 38, may each be generally longitudinal and extend generally parallel to the gusset 26. The pocket 34 may be movably or pivotally coupled to the outer surface of the binder 10. In particular, the pocket 34 may be pivotally coupled to one of the gusset portions 26*a*, 26*b* and/or to one of the covers 12, 14. In the illustrated embodiment, the pocket 34 is coupled to the second gusset portion 26*b* along hinge line 52 (FIG. 2). For example, the lower or inner edge 54 of the pocket 34 may be stitched to the gusset portion 26*b* and/or the rear cover 14 along the hinge line 52. In this manner, the pocket 34 can be pivoted between a compact position wherein the pocket 34 is oriented generally parallel to and adjacent the gusset 26 and generally perpendicular to the front 12 and rear 14 covers (FIG. 1) and an expanded position wherein the pocket 34 is oriented generally perpendicular to the gusset 26 and generally parallel to the front and rear covers 12, 14.

The pocket 34 may include a patch of hook and loop fastening material 48 located thereon, and the gusset 26 and/or front cover 12 may include a corresponding patch of hook and loop fastening material 50 located thereon (see FIG. 2). In this manner, the patches 48, 50 of hook and loop fastening material can cooperate to maintain the pocket 34 in the compact position where the pocket 34 lies flat against the gusset 26.

The pocket 34 may be normally stowed in its compact position, and may be moved to its expanded position when it is desired to access the portion of the zipper track 31 that is located below the pocket 34 when the pocket 34 is in its compact position. For example, the pocket 34 may be moved to its expanded position when it is desired to zip or unzip the binder 10 such that the zipper pull 33 may be moved past the pocket 34. Once the zipper pull 33 has been moved past the pocket 34, the pocket 34 may then be returned to its compact position.

In the illustrated embodiment, the gusset 26 extends between the front 12 and rear 14 covers in a thickness direction A of the binder 10, and the pocket 34 at least partially overlaps the gusset 26 in the thickness direction. In this manner, the pocket 34 may at least partially overlap with the gusset 26.

The pocket 34 provides a conveniently located and easily accessible storage compartment for storing components. For example, pens, pencils, sunglasses, cellular phones, personal organizers and the like may be easily stored in the pocket 34. Furthermore, because the pocket 34 is coupled to or located on an outer surface of the binder 10, the contents of the pocket 34 can be easily accessed without having to open the binder 10. Because the pocket 34 is located on an end of the binder 10, the pocket 34 can be accessed, even when the binder 10 is located between other adjacent components (i.e., book, binders, etc.) such as when the binder 10 is stored in a locker or backpack. Furthermore, when the pocket 34 is in its compact position, the pocket 34 may help to maintain the binder in its closed position, even when the first 26*a* and second 26*b* portions are not coupled together by the zipper 30, by operation of the patches of hook and loop material 48, 50.

Figure 4:
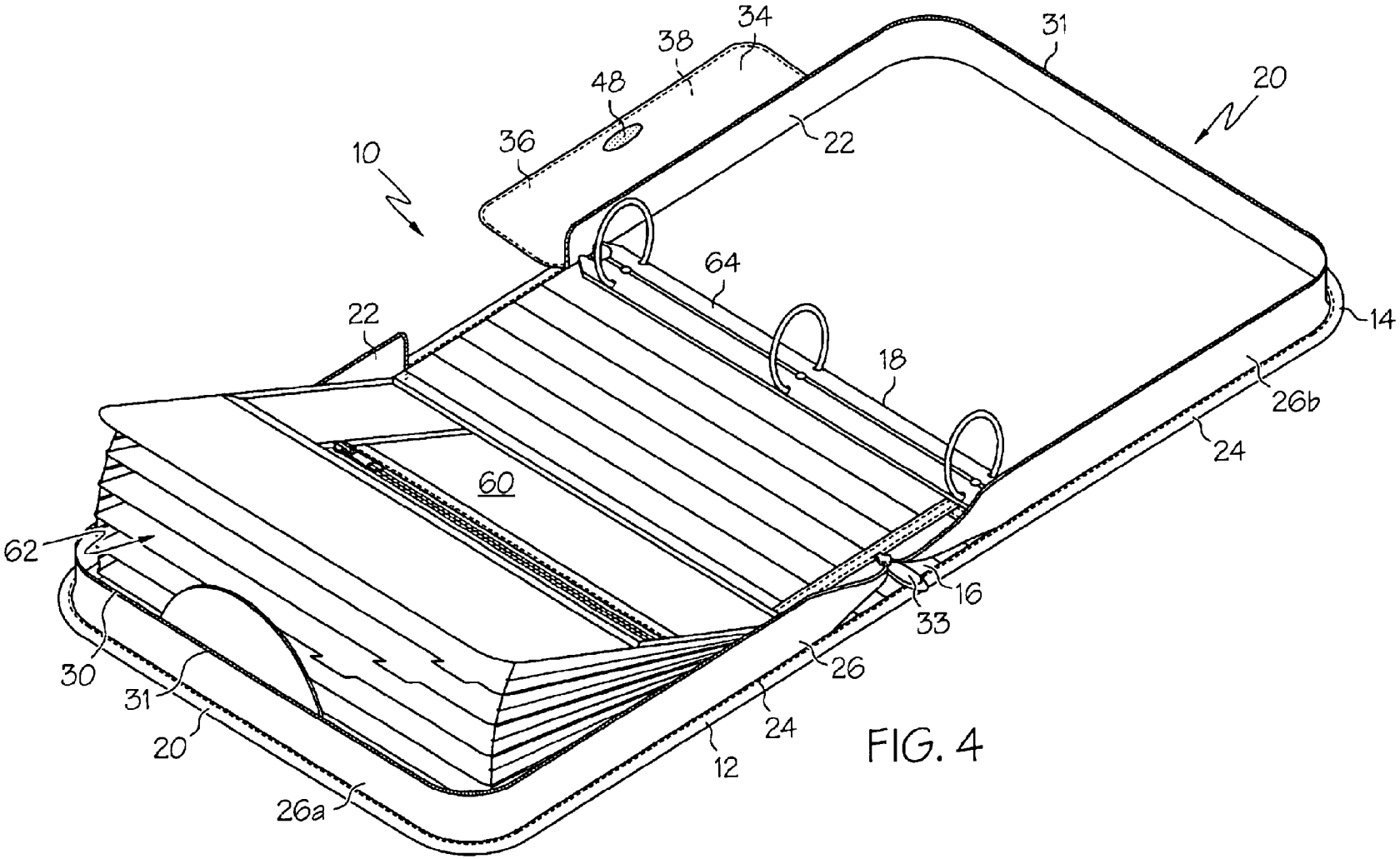
FIG. 4 is a front perspective view of the binder of FIG. 1, with the binder in its open position.

In one embodiment, as shown in FIG. 4, the binder 10 may have a variety of pockets 60, folders 62, and other storage components on its inner surface. The binder 10 may also include a binding mechanism 64, such as a three ring binding mechanism, located on an inner surface of the binder 10, such as on an inner surface of the spine 16 or one of the covers 12, 14.

Having described the invention in detail and by reference to the preferred embodiments, it will be apparent that modifications and variations thereof are possible without departing from the scope of the invention.

What is claimed is:

1. A binder comprising:

a front cover;

a rear cover directly or indirectly coupled to said front cover;

a gusset extending generally between said front and rear covers; and a pocket located on an outer surface of said binder, said pocket at least partially overlapping with at least part of said gusset.

2. The binder of claim 1 wherein each of said front and rear covers includes a rear edge, said front and rear covers being coupled along their rear edges, and wherein said gusset does not extend along said rear edges.

3. The binder of claim 1 wherein said front and rear covers are generally rigid, and wherein said gusset is generally flexible as compared to said front and rear covers.

4. The binder of claim 1 wherein said gusset extends between said front and rear covers in a thickness direction of said binder, and wherein pocket at least partially overlaps said gusset in said thickness direction.

5. The binder of claim 1 wherein said pocket is directly coupled to said gusset.

6. The binder of claim 1 wherein said front and rear covers are generally rectangular, generally rigid and generally planar, and wherein said binder includes a spine located between said front and rear covers, each of said front and rear covers being pivotally coupled to said spine.

7. The binder of claim 6 wherein said binder includes a first side generally opposite said spine, and second and third sides extending generally perpendicular to said first side between said spine and said first side, and wherein said pocket is located on one of said first, second or third sides.

8. The binder of claim 6 wherein said gusset extends at least partially around at least three sides of said covers.

9. The binder of claim 8 wherein said gusset is fixedly coupled to said front and rear covers.

10. The binder of claim 1 wherein said gusset includes a first portion coupled to said front cover and a second portion coupled to said rear cover, said first and second portions being releasably attachable together.

11. The binder of claim 10 wherein said binder includes a fastening mechanism for releasably attaching said first and second portions together.

12. The binder of claim 10 wherein said pocket overlaps at least part of said first and said second portions.

13. The binder of claim 10 wherein said pocket is pivotally coupled to one of said first or second portions.

14. The binder of claim 13 wherein said pocket is releasably attachable to the other of said front or rear portions.

15. The binder of claim 1 wherein said pocket is movably coupled to said outer surface.

16. The binder of claim 1 wherein said pocket is pivotally coupled to said outer surface.

17. The binder of claim 16 wherein said pocket is pivotable between a compact position, wherein said pocket is oriented generally perpendicular to at least one of said front or rear covers, and an expanded position wherein said pocket is oriented generally parallel to at least one of said front or rear covers.

18. The binder of claim 1 wherein said pocket includes an outer body having an inner cavity therein.

19. The binder of claim 18 wherein said inner cavity is generally longitudinal and extends generally parallel to said gusset.

20. The binder of claim 18 wherein said pocket includes an access opening to provide access to said inner cavity, and wherein said pocket includes a closure flap to selectively cover said access opening.

21. The binder of claim 20 wherein said pocket is attachable to said gusset to retain said binder in a generally closed position.

22. The binder of claim 1 wherein said binder is movable to a closed position wherein said covers are generally parallel and face each other.

23. The binder of claim 1 further including a binding mechanism located on an inner surface of said binder.

24. The binder of claim 1 wherein said gusset extends generally perpendicular to said front and rear covers.

25. A binder comprising:

a front cover;

a rear cover directly or indirectly coupled to said front cover;

a gusset extending generally between said front and rear covers; and a pocket pivotally coupled to said binder on an outer surface thereof, wherein said pocket is pivotable between a compact position, wherein said pocket is oriented generally perpendicular to at least one of said front or rear covers, and an expanded position wherein said pocket is oriented generally parallel to at least one of said front or rear covers.

26. The binder of claim 25 wherein each of said front and rear covers includes a rear edge, said front and rear covers being coupled along their rear edges, and wherein said gusset does not extend along said rear edges.

27. The binder of claim 25 wherein said front and rear covers are generally rigid, and wherein said gusset is generally flexible as compared to said front and rear covers.

28. The binder of claim 25 wherein said pocket at least partially overlaps with said gusset.

29. The binder of claim 25 wherein said gusset extends between said front and rear covers in a thickness direction of said binder, and wherein pocket at least partially overlaps said gusset in said thickness direction.

30. The binder of claim 25 wherein said pocket is directly coupled to said gusset.

31. The binder of claim 25 wherein said front and rear covers are generally rectangular, generally rigid and generally planar, and wherein said binder includes a spine located between said front and rear covers, each of said front and rear covers being pivotally coupled to said spine.

32. The binder of claim 31 wherein said binder includes a first side generally opposite said spine, and second and third sides extending generally perpendicular to said first side between said spine and said first side, and wherein said pocket is located on one of said first, second or third sides.

33. The binder of claim 25 wherein said gusset extends at least partially around at least three sides of said covers and is fixedly coupled to said front and rear covers.

34. The binder of claim 25 wherein said gusset includes a first portion coupled to said front cover and a second portion coupled to said rear cover, said first and second portions being releasably attachable together.

35. The binder of claim 34 wherein said pocket overlaps at least part of said first and said second portions.

36. The binder of claim 34 wherein said pocket is pivotally coupled to one of said first or second portions.

37. The binder of claim 36 wherein said pocket is releasably attachable to the other of said front or rear portions.

38. The binder of claim 25 wherein said pocket includes an outer body having an inner cavity therein, and wherein said inner cavity is generally longitudinal and extends generally parallel to said gusset.

39. The binder of claim 25 wherein said pocket is attachable to said gusset to retain said binder in a generally closed position.

40. The binder of claim 25 further including a binding mechanism located on an inner surface of said binder.

41. A binder comprising:

a generally flat, planar front cover;

a generally flat, planar rear cover;

a spine located between said front and rear covers, said front and rear covers each being pivotally coupled to said spine;

a gusset extending generally between said front and rear covers in a direction generally perpendicular to said front and rear covers, a first portion of said gusset being fixedly coupled to said front cover and a second portion of said gusset being fixedly coupled to said rear cover, said first and second portions being releasably attachable together; and a pocket located on an outer surface of said binder, said pocket extending at least partially along said gusset.

* * * * *